US005322713A

United States Patent [19]

van Ooij et al.

[11] Patent Number: 5,322,713

[45] Date of Patent: * Jun. 21, 1994

[54] METAL SHEET WITH ENHANCED CORROSION RESISTANCE HAVING A SILANE TREATED ALUMINATE COATING

[75] Inventors: Wim J. van Ooij, Fairfield; Ashok Sabata, Middletown, both of Ohio

[73] Assignee: Armco Inc., Middletown, Ohio

[ * ] Notice: The portion of the term of this patent subsequent to Apr. 28, 2009 has been disclaimed.

[21] Appl. No.: 36,340

[22] Filed: Mar. 24, 1993

[51] Int. Cl.[5] ..... B05D 3/12

[52] U.S. Cl. ..... 427/327; 427/337; 427/387; 427/388.4

[58] Field of Search ..... 427/327, 337, 387, 388.4; 422/13

[56] References Cited

U.S. PATENT DOCUMENTS 5,108,793 4/1992 van Ooij et al. ..... 427/327

FOREIGN PATENT DOCUMENTS 141436 11/1977 Japan .
32157 2/1987 Japan .
130796 6/1988 Japan .

*Primary Examiner*—Shrive Beck
*Assistant Examiner*—David M. Maiorana
*Attorney, Agent, or Firm*—R. J. Bunyard; L. A. Fillnow; R. H. Johnson

[57] ABSTRACT

Metal sheet protected against corrosion by a silane treated inorganic aluminate coating. A thin aluminate coating was formed by immersing a galvanized steel sheet into an alkaline solution containing 0.005M dissolved aluminate for about 30 seconds. The sheet was dried to form an adherent aluminate coating having a thickness of at least 50 Å. The aluminate coated sheet was immersed into a solution containing 1.0 vol.-% hydrolyzed organofunctional silane for about 5 seconds forming a silane film having a thickness of at least 20 Å on the outer surface of the aluminate coating. Thereafter, the silane treated aluminate coated sheet was painted. The silane film formed a covalent bond between the outer paint layer and the inner aluminate layer. A steel sheet treated with the silane sealed aluminate coating had good corrosion protection, good paint chipping resistance and good paint formability.

18 Claims, No Drawings

METAL SHEET WITH ENHANCED CORROSION RESISTANCE HAVING A SILANE TREATED ALUMINATE COATING

BACKGROUND OF THE INVENTION

This invention relates to a method of protecting metal with a nontoxic, relatively insoluble, inorganic, corrosion resistant coating. More particularly, the invention relates to a metal sheet having a silane treated aluminate coating. The coating is formed by a two step process including sequentially rinsing the sheet with an alkaline solution containing a dissolved aluminate and another solution containing a hydrolyzed organofunctional silane.

U.S. Pat. No. 5,108,793; incorporated herein by reference, relates to a two step process for forming a steel sheet having a silane treated inorganic silicate coating. The coating is formed by rinsing the sheet in an alkaline solution having a temperature of at least 25° C. containing 0.005M metal salt. The sheet is dried to form a silicate coating having a thickness of at least 2 Å prior to being treated with an aqueous solution containing 0.5–5 vol.-% silane. The silane treated silicate coating provides good corrosion protection on cold-rolled and metallic coated steel when the steel is pretreated with a phosphate conversion coating. For painted steels, the silane film forms an adherent bond between the paint and the silicate coating. When a phosphate conversion coating is not applied, however, the silicate coating may be brittle and have inferior adhesion to the steel.

It also is known to protect galvanized or cold-rolled steel with a silane treated alumina, silica and/or zirconia hydrate. The hydrate coating is formed by immersing the steel into a bath containing a suspension of the oxide particles. Such a hydrate coating generally is a thick, brittle coating that does not provide good paint chipping resistance or good formability. Another disadvantage is non uniformity of the coating because the rinsing solution must be constantly stirred to maintain the oxide particles in suspension.

As evidenced by the effort of previous workers, there has been a long felt need to develop a corrosion resistant coating for cold-rolled steel sheet as well as metallic coated steel sheet that has good paint chipping resistance and good formability. There also has been a need to develop a low cost corrosion resistant coating formed using environmentally safe coating solutions that can be disposed of inexpensively.

BRIEF SUMMARY OF THE INVENTION

The invention relates to a metal sheet having a nontoxic, inorganic, thin corrosion resistant coating. A method for coating includes rinsing the sheet for a short period of time with an alkaline solution containing a dissolved aluminate, drying the sheet to form a thin aluminate coating and treating the aluminate coated sheet with another solution containing a hydrolyzed organofunctional silane.

Another feature of the invention includes the aforesaid alkaline solution having a concentration at least 0.001M aluminate and the aforesaid aluminate coating having an average thickness of about 2–100 Å.

Another feature of the invention includes the aforesaid silane solution containing at least 0.1 vol. % silane and the aforesaid silane film having an average thickness of about 1–50 Å.

Another feature of the invention includes the aforesaid aluminate coating being from the group consisting of $NaAl(OH)_4$, $KAl(OH)_4$ or $LiAl(OH)_4$.

A principal object of the invention is to provide a painted metal sheet having good corrosion resistance, good paint chipping resistance and good paint formability.

Another object of the invention is to provide good corrosion resistance on a metal sheet without using coating solutions or creating waste materials, neither of which contains toxic substances.

Additional objects include forming a corrosion resistant coating that has a low cost and is formed using a high speed processing line.

Advantages of the invention include a corrosion resistant coating that can be applied to a variety of metal sheet surfaces, no environmentally hazardous waste substances to dispose of and good paint adherence without pretreating the sheet surface with a phosphate conversion coating.

DETAILED DESCRIPTION OF THE PREFERRED EMBODIMENTS

It previously was known to form an adherent corrosion resistant silicate coating on a steel sheet after pretreating the sheet with a phosphate conversion coating. If the phosphate conversion coating was omitted, however, the silicate coating may not be very adherent to the steel substrate, especially if the steel sheet is deeply drawn into a formed part. We have determined a silane treated aluminate coating can provide excellent adherence and corrosion resistance in industrial applications on a variety of metal substrates even when the substrate is not pretreated with a phosphate conversion coating. The silane treated aluminate coating of the invention can be applied to metal surfaces such as hot rolled and picked steel sheets, cold-rolled steel sheets, hot-dipped or electroplated metallic coated steel sheets, aluminum sheets or aluminum alloy sheets. The metallic coating may include one or more layers of zinc, zinc alloy, aluminum, aluminum alloy and the like. By sheet is meant to include continuous strip or foil and cut lengths. The invention has particular utility for cold-rolled steel sheets, galvanized steel sheets and aluminum sheets that are to be painted electrostatically with a powder or cathodically electrocoated with a liquid. A thin inorganic aluminate coating treated with an organofunctional silane improves corrosion protection and strengthens the bond between the paint and the metal substrate.

An important aspect of the invention is being able to quickly form a nontoxic, insoluble coating having sufficient thickness to provide long term corrosion resistance. Coating times in excess of 120 seconds generally do not lend themselves to industrial applicability. We have determined a silane treated corrosion resistant aluminate coating having a thickness of at least 2 Å, preferably at least 10 Å, could be formed by rinsing a metal sheet in as little as 5 seconds with an alkaline solution containing a dissolved aluminate.

Another important aspect of the invention is forming an aluminate coating wherein an organofunctional silane coupling agent is applied as a film onto the outer surface of the aluminate coating. Accordingly, the aluminate and the silane are dissolved in separate solutions so that the metal sheet first is rinsed with a solution containing the dissolved aluminate. After the aluminate is dried into a relatively insoluble layer, the aluminate coated sheet then is surface treated, e.g., rinsed, with the solution containing a hydrolyzed silane.

Possible inorganic aluminate coatings include sodium aluminate, potassium aluminate and lithium aluminate with $NaAl(OH)_4$ being preferred. The aluminate may be prepared by dissolving an aluminum salt such as $Al(NO_3)_3.xH_2O$ or $Al_2(SO_4)_3.xH_2O$ in NaOH having a pH preferably of at least 10. The concentration of the aluminate in the alkaline solution preferably is in the range of 0.001–0.05M, with at least 0.005M being more preferred. For cold-rolled steel sheet, an alkaline solution containing $NaAl(OH)_4$ forms an adherent film of hydrated $Al_2O_3$ or a mixed oxide such as spinel oxide, e.g., $FeAl_2O_4$. For galvanized steel sheet, a mixed oxide film of $ZnAl_2O_4$ is formed. The highly alkaline —OH groups at the oxide surface are very reactive with silanes, forming a hydrolytically stable Al—O—Si— bond. The concentration of aluminate in the alkaline solution should be at least about 0.001M to form an inorganic coating that is impervious to moisture. At concentrations greater than about 0.05M, corrosion and paint adhesion performance are not improved and the cost becomes excessive.

Preferably, the aluminate solution also includes an alkaline earth metal salt such as calcium prepared by dissolving $Ca(NO_3)_2$ in the solution. A metal salt may be included in the solution to insure that the inorganic aluminate coating is insoluble. After being formed on the metal sheet, the inorganic aluminate coating must not be dissolved during subsequent processing of the sheet or must not be dissolved by the corrosive environment within which the sheet is placed. Since the metal salt reacts in direct proportion to the dissolved aluminate, the concentration of the salt should be at least equal to the concentration of the dissolved aluminate. Accordingly, an acceptable concentration of the metal salt in the solution is 0.001–0.05M. Alternatively, strontium or barium can be used instead of calcium by dissolving $Sr(NO_3)_2$ or $Ba(NO_3)_2$ in the aluminate solution.

The alkaline solution also may include a dissolved silicate in addition to aluminate for forming a mixed aluminate-silicate coating. In this embodiment, the concentration of the aluminate may be about equal to that of the silicate, e.g., 0.003M aluminate and 0.003M silicate. Either of the inorganic aluminate or the mixed aluminate-silicate coatings of this invention is more adherent to metal than the silicate coating disclosed in U.S. Pat. No. 5,108,793.

The aluminate coating must be thin preferably having an average thickness in the range of about 2–100 Å, with about 50 Å being most preferred. An average aluminate coating thickness of at least 2 Å is desired to ensure there are no uncoated areas on the surface of the steel sheet. An aluminate coating thickness above 100 Å is undesirable because a thick coating is not readily formable during subsequent processing of the sheet and paint chipping resistance deteriorates.

To be used as a coupling agent for forming a continuous film on an aluminate coating, the silane is hydrolyzed in an aqueous solution by being acidified preferably in concentrations of about 0.1–5.0 vol.-% with at least 1.0 vol.-% being more preferred. The concentration should be at least about 0.1 vol.-% to insure the aluminate coating is completely covered with a dense silane film without any uncoated areas. A silane concentration above 5.0 vol.-% is undesirable because paint wettability with the aluminate and adhesion performance is not improved and the cost becomes excessive. The thickness of the silane film should be about 1–50 Å and preferably about 20 Å. A silane thickness of about 1 Å is necessary to properly seal and to form a covalent bond between the inner aluminate layer and an outer paint layer. Silane thicknesses greater than 50 Å are undesirable because they may be brittle and impair formability.

The rate of reaction for forming the aluminate coating also is a function of the alkalinity of the alkaline solution. At a pH less than about 10, the rate of reaction may be too slow to form the minimum coating thickness in a reasonable period of time, particularly when the rinse solution temperature approaches ambient. At a pH greater than about 12, the rate of reaction is not increased appreciably and the phosphate coating is attacked if the sheet is pretreated with a phosphate conversion coating. The pH of the aluminate solution may be adjusted using $H_3PO_4$, NaOH or KOH.

No particular immersion time, temperature or pH is required for the silane solution so long as the silane is adsorbed onto the outer surface of the aluminate coating. For metal sheets to be painted, the silane is adsorbed into the outer surface of the aluminate coating and provides a primary bond between the paint and the aluminate. For metal sheets not painted, the silane film stabilizes the aluminate, i.e., is less reactive in an alkaline environment. Possible silanes include γ-glycidoxypropyltrimethoxy (GPS), γ-aminopropyltrie(m)ethoxy (APS), γ-methacryloxypropyltrimethoxy (MPS) and N-[2-(vinylbenzylamino)ethyl]-3-aminopropyltrimethoxy (SAAPS) with SAAPS silane being preferred. It will be understood other organofunctional silanes may be used with the invention.

By way of examples, the invention now will be described in detail.

EXAMPLE 1

A low carbon deep drawing steel strip was hot dipped galvanized with 90 g/m$^2$ of zinc on each side. The strip then was immersed into a bath containing a conventional zinc phosphate conversion coating. Test panels of the phosphated galvanized steel were cut from the strip. For control sample 1, no further treatment was provided to the test panels. For control sample 2, additional test panels were treated with a standard chromate rinse. For sample 3 of the invention, an aluminate solution was prepared having a concentration of 0.005M aluminate and the pH was adjusted to 12 using NaOH. The solution was heated to a temperature of 60° C. After being in the aluminate solution for 30 seconds, the test panels were removed and blown dry with air. A 10 vol.-% aqueous SAAPS silane solution was prepared by hydrolyzing pure silane with acetic acid at 20° C. and diluting the solution to 1.0 vol.-% in water. Then, the aluminate coated test panels were rinsed in the SAAPS silane solution for 5 seconds. For sample 4 of the invention, calcium was dissolved in the aluminate solution. $Ca(NO_3)_2$ was added until a calcium concentration of 0.005M was obtained. Test panels for sample 4 then were coated with the inorganic aluminate coating, dried and treated with the silane in a manner similar to that described above for sample 3. The thickness of the aluminate coating on samples 3 and 4 of the invention was about 50 Å and the thickness of the outer silane film was about 20 Å. All of the test panels described above for samples 1–4 then were coated with a conventional automotive coating, e.g., a cathodic electrocoat (E-coat) and an acrylic-melamine topcoat. The paint on samples 1–4 was cured at 175° C. for 25 minutes and had a total paint thickness of about 100 μm. The painted test panels then were scribed and exposed for eight weeks to the standard GM (General Motors Corporation) scab corrosion test. Corrosion and paint adherence results of the steels are summarized in Table 1.

TABLE 1

| Sample | Treatment | Ave. Paint Delamination From Scribe (mm) | NMPRT** |
|---|---|---|---|
| 1 | Phos* only | 1.70 | 15 min. |
| 2 | Phos* + Chrome*** | 1.13 | 18 min. |
| 3 | Phos* + Alum + SAAPS | 1.23 | >1 hr. |
| 4 | Phos* + Alum + $Ca^{+2}$ + SAAPS | 0.96 | >1 hr. |

*Phos is a standard zinc phosphate conversion coating.
**NMPRT is a measure of paint adherence described in U.S. Pat. No. 5,108,793.
***Chrome is a standard chromate post rinse.

The results of this test clearly demonstrated that the control test panels for samples 1 and 2 had inferior paint adherence when compared to samples 3 and 4 of the invention which were coated with a silane sealed aluminate coating. Including calcium in the inorganic aluminate coating of sample 4 of the invention demonstrated a positive effect on corrosion performance as indicated by the appearance of scribe creepback being less than 1.0 mm during the scribe test.

EXAMPLE 2

For samples 5–9, none of the galvanized test panels were pretreated with a phosphate conversion coating. Control sample 5 was not treated with an inorganic coating or silane. For samples 6 and 7 of the invention, the test panels were treated in a manner similar to that described above for samples 3 and 4 respectively. For sample 8, the only treatment given to the test panels was a silicate coating similar to that described for the examples of U.S. Pat. 5,108,793. Sample 9 was treated similar to sample 8 except the silicate coated test panels were treated with the SAAPS silane described above for sample 6. All of the test panels described above for samples 5–9 then were coated with a polyester powder paint. The paint was cured at 175° C. for 30 minutes and had a total paint thickness of about 75 μm. The painted test panels then were subjected to the corrosion tests described above for samples 1–4. Corrosion and paint adherence results of the steels are summarized in Table 2.

TABLE 2

| Sample | Treatment | Ave. Paint Delamination From Scribe (mm) | NMPRT |
|---|---|---|---|
| 5 | None | 1.60 | 3 min. |
| 6 | Aluminate + SAAPS | 4.70 | >1 hr. |
| 7 | Aluminate + $Ca^{+2}$ + SAAPS | 1.35 | >1 hr. |
| 8 | Silicate | X | X |
| 9 | Silicate + SAAPS | 1.40 | >1 hr. |

X = complete delamination of the paint occurred.

Although the results of this test demonstrated that samples 6 and 7 of the invention had good paint adherence when the test panels were not pretreated with the phosphate conversion coating, sample 6 had inferior scribe creepback protection. When the aluminate solution contained a calcium salt for the test panels of sample 7, however, scribe creepback protection was excellent. Not being bound by theory, it is believed the corrosion protection of sample 7 was superior to that of sample 6 because including calcium in the inorganic coating of sample 7 made the aluminate layer less soluble at the high pH in the scribe region of the corrosion process. Sample 8 which was treated with a silicate coating but not sealed with a silane resulted in complete failure of the paint. The corrosion protection and paint adherence results for sample 9 was comparable to the performance of the test panels of the invention disclosed herein.

The results in Tables 1 and 2 demonstrated that galvanized steel, with or without a phosphate conversion coating, had comparable corrosion resistance and paint adherence performance when treated with a silane sealed aluminate or a silane sealed silicate coating. Nevertheless, the silane sealed aluminate coating of the present invention is superior to the silane sealed silicate coating disclosed in U.S. Pat. No. 5,108,793 for cold-rolled and electrogalvanized steels which are not pretreated with a phosphate conversion coating. The reason for superior corrosion resistance and improved paint adherence performance for the silane treated aluminate coating of this invention for cold-rolled and electrogalvanized steels is because the aluminate can form a mixed oxide coating. For example, an inorganic aluminate coating forms a mixed oxide of alumina and iron oxide on cold-rolled steel and forms a mixed oxide of alumina and zinc oxide on electrogalvanized steel. An inorganic silicate coating can not form such a mixed oxide.

It will be understood various modifications can be made to the invention without departing from the spirit and scope of it. Therefore, the limits of the invention should be determined from the appended claims.

What is claimed is:

1. A method of coating a metal sheet with a nontoxic, inorganic, corrosion resistant coating, comprising the steps of:

providing an alkaline solution containing a dissolved aluminate, rinsing the sheet with the alkaline solution, drying the sheet thereby forming a relatively insoluble thin aluminate coating, and rinsing the aluminate coated sheet with a solution containing a hydrolyzed organofunctional silane.

2. The method of claim 1 wherein the alkaline solution includes a metal salt.

3. The method of claim 2 wherein the metal salt is from the group consisting of calcium, strontium and barium.

4. The method of claim 1 wherein the alkaline solution has an aluminate concentration of at least 0.001M.

5. The method of claim 1 wherein the alkaline solution further includes a dissolved silicate.

6. The method of claim 1 wherein the silane solution has a concentration of at least 0.1 vol.-% silane.

7. The method of claim 1 wherein the aluminate coating has a thickness of at least 2 Å.

8. The method of claim 7 wherein the sheet is rinsed with the alkaline solution for at least 5 seconds.

9. The method of claim 1 wherein the silane film has a thickness of at least about 1 Å.

10. The method of claim 9 wherein the sheet is rinsed in the silane solution at least 1 second.

11. The method of claim 1 wherein the aluminate coating is from the group consisting of $NaAl(OH)_4$, $KAl(OH)_4$ and $LiAl(OH)_4$.

12. The method of claim 11 wherein the aluminate coating forms a mixed oxide of aluminum and at least one of iron and zinc.

13. The method of claim 1 including the additional step of painting the silane treated sheet.

14. The method of claim 1 wherein the base metal of the sheet is steel.

15. The method of claim 14 wherein the sheet is coated with hot-dipped or electroplated zinc or zinc alloy prior to being coated with the aluminate coating.

16. The method of claim 15 wherein the aluminate coating forms a mixed oxide of aluminum oxide and zinc oxide.

17. A method of coating a metal sheet with a nontoxic, inorganic, corrosion resistant coating, comprising the steps of:

providing an alkaline solution containing at least 0.001M of a dissolved aluminate, rinsing the sheet with the alkaline solution for at least 5 seconds, drying the sheet thereby forming a relatively insoluble aluminate coating having a thickness of at least 2 Å, rinsing the aluminate coated sheet with a solution containing at least 0.1 vol.-% hydrolyzed organofunctional silane, and painting the silane treated aluminate coated metal sheet.

18. A method of coating a steel sheet with a nontoxic, inorganic, corrosion resistant coating, comprising the steps of:

providing an alkaline solution containing at least 0.001M each of a dissolved aluminate and a metal salt, rinsing the sheet with the alkaline solution for at least 5 seconds, drying the sheet thereby forming a relatively insoluble aluminate coating having a thickness of 2–100 Å, rinsing the aluminate coated sheet for at least 1 second with a solution containing at least 0.1 vol.-% hydrolyzed organofunctional silane thereby forming a silane film having a thickness of 1–50 Å, and painting the silane treated aluminate coated steel sheet.

* * * * *